US009362061B2

(12) United States Patent
Endre et al.

(10) Patent No.: US 9,362,061 B2
(45) Date of Patent: Jun. 7, 2016

(54) SWITCHING DEVICE AND A SWITCHGEAR

(71) Applicant: ABB Technology AG, Zurich (CH)

(72) Inventors: Thor Endre, Skien (NO); Tom-Rune Bjortuft, Porsgrunn (NO); Paal Kristian Skryten, Skien (NO); Havard Hadland, Skien (NO); John-Anders Tveten, Porsgrunn (NO); Stanley Lohne, Porsgrunn (NO); Jan-Arild Zinke, Porsgrunn (NO); Robert Espeseth, Skien (NO)

(73) Assignee: ABB Technology AG, Zurich (CH)

( * ) Notice: Subject to any disclaimer, the term of this patent is extended or adjusted under 35 U.S.C. 154(b) by 66 days.

(21) Appl. No.: 14/108,057

(22) Filed: Dec. 16, 2013

(65) Prior Publication Data

US 2014/0097069 A1 Apr. 10, 2014

Related U.S. Application Data

(63) Continuation of application No. PCT/EP2011/060056, filed on Jun. 16, 2011.

(51) Int. Cl.

| | |
|---|---|
| ***H01H 33/666*** | (2006.01) |
| ***H01H 1/50*** | (2006.01) |
| ***H01H 31/00*** | (2006.01) |
| ***H01H 33/12*** | (2006.01) |

(52) U.S. Cl.

CPC ..... *H01H 1/50* (2013.01); *H01H 1/502* (2013.01); *H01H 31/003* (2013.01); *H01H 33/125* (2013.01); *H01H 33/6661* (2013.01)

(58) Field of Classification Search

CPC ... H01H 33/6661; H01H 9/08; H01H 31/003; H01H 33/027; H01H 33/022; H02B 13/0352

USPC ..... 200/502, 400, 307; 218/154, 120, 140, 218/7, 153

See application file for complete search history.

(56) References Cited

U.S. PATENT DOCUMENTS

| | | | | |
|---|---|---|---|---|
| 5,775,469 | A * | 7/1998 | Kang | 188/267 |
| 2005/0247677 | A1* | 11/2005 | Perret | 218/140 |
| 2011/0226528 | A1* | 9/2011 | Endre et al. | 174/70 B |

FOREIGN PATENT DOCUMENTS

EP 2337052 A1 6/2011

* cited by examiner

*Primary Examiner* — R S Luebke
*Assistant Examiner* — Ahmed Saeed
(74) *Attorney, Agent, or Firm* — Whitmyer IP Group LLC

(57) ABSTRACT

A switching device including a breaker electrically connectable to an electrical conductor, and an at least partially electrically conductive housing to which the breaker is mounted, the housing having an outer surface. The breaker includes an electrically conductive first contact and an electrically conductive second contact, the second contact being movable and in relation to the first contact and in relation to the housing, and when the first and second contacts are in contact the breaker is in a closed position, and when the first and second contacts are separated the breaker is in an open position. The switching device is arranged to provide a current path between the breaker and the electrical conductor, and the housing houses a guiding member for operating the second contact, the guiding member being movable in relation to the housing, wherein the guiding member includes a biasing assembly.

20 Claims, 17 Drawing Sheets

SWITCHING DEVICE AND A SWITCHGEAR

FIELD OF THE INVENTION

The present invention relates to a switching device for electric power distribution, electrically connectable to an electrical conductor. The switching device comprises a breaker electrically connectable to the electrical conductor, and an at least partially electrically conductive housing to which the breaker is mounted, the housing having an outer surface. The breaker comprises at least one electrically conductive first contact and one electrically conductive second contact, the second contact being movable and in relation to the first contact and in relation to the housing, and when the first and second contacts are in contact the breaker is in a closed position, and when the first and second contacts are separated the breaker is in an open position. The switching device is arranged to provide a current path between the breaker and the electrical conductor, and the housing houses at least one guiding member for operating the second contact, the at least one guiding member being movable in relation to the housing. Further, the present invention relates to a switchgear comprising at least one switching device of the above-mentioned sort.

BACKGROUND OF THE INVENTION

Switchgears for medium and/or high voltage, e.g. 1-1000 kV, such as 12, 24 or 36 kV, of prior art normally comprise one to five modules housed in a casing, or encapsulation, and each module comprises at least three electrical bushings (one for each phase of a three phase AC power distribution system), conductors leading from each electrical bushing to a respective breaker, e.g. a vacuum interrupter, selector switches (one for each breaker), and busbars (one for each phase). The selector switches are used for connecting the breaker to the busbars or disconnecting them from the latter. Each selector switch normally comprises a switch knife movable between positions in which it is connected to or disconnected from the busbar.

The breaker is often a vacuum interrupter, which may be spring loaded, and is provided to interrupt the electric circuit upon occurrence of specific operational conditions. After such breaking, the selector switches may be manually or automatically disconnected from the respective busbar, either to a position in which the selector switch is connected to ground or an open position in which, for example, electric measurements on the components on the breaker side of the switch may be performed.

Examples of switchgears are disclosed in each of US2008/0217153 A1, US2004/0104201 A1 and DE 3528770 A1, in which a switchgear is disclosed, which for each phase has a breaker, a busbar and a movable switching element which is pivotable between a first position, in which the switching element electrically connects the breaker to the busbar, a second position, in which the switching element is connected to ground/earth, and a third position in which the switching element is disconnected from both the busbar and ground, the third position corresponding to a switched-off position.

US 2005/0241928 A1 discloses an electric power interrupter with an internal contactor for use as a line or load switch constructed from light weight materials.

U.S. Pat. No. 3,919,511 discloses a circuit breaker equipped with a mechanism housing which is partly covered by half-shells consisting of electrically conductive material in order to not impair the electric field in the interior of the breaker housing.

U.S. Pat. No. 5,057,654 discloses an interrupter switch assembly provided with an interrupter unit having a moulded housing and a cover portion with which a conductive portion of a conductive shunt current path is integrally moulded, the conductive portion being generally a thin member or strip.

US 2002/0179571 A1 discloses an electrical circuit interrupter device for a power distribution system, comprising a housing made of a conductive material, e.g. aluminium, forming part of the electrical connection between a first terminal and a second terminal. The housing is connected to a circuit interrupter, e.g. a vacuum interrupter, situated between the first terminal and the housing, and the housing houses a manual handle and lever mechanism assembly for operating the circuit interrupter. Alternatively, the housing is made of a non-conductive material with a conductive shunt forming part of the electric connection between the first and second terminals.

WO 2004/032298-A1 discloses a gas-insulated switch of a compact structure including a vacuum interrupter, where components are fixed to and electrically connected to conductive cases for mitigating the electric field of a movable contact unit of each component.

U.S. Pat. No. 5,003,427 discloses a metal enclosed multiphase high voltage switching arrangement, including a busbar, a power switch and a three-way switch.

U.S. Pat. No. 5,276,286 discloses an exposed outdoor disconnector for operating under icing conditions, including a vacuum switch mounted to a protective metal cover, the metal cover housing members for operating the vacuum switch. JP2001 143582-A discloses a vacuum breaker connected to a housing. WO 01/78100-A1 discloses an isolating circuit breaker for pole mounting including a vacuum interrupter mounted to a housing made of a metallic material, and the housing houses a guiding member for operating the vacuum interrupter.

EP2 180 490-A1, US 2008/0217153-A1, US 2004/0104201-A1 and DE 35 28 770-A1 disclose a switching device comprising a breaker and a switch element pivotable about a pivot axis between three positions. In a first position the switch element is electrically connected to the breaker and a bus bar. In a second position the switch element is electrically connected to the breaker and a grounded element. In a third position the switch element is disconnected from both the busbar and the grounded element.

SUMMARY OF THE INVENTION

Switchgears should be designed to prevent the upcoming of discharges, arcs or flashover between components of the switchgear. Prior art switchgears may require too much space in order fulfil safety regulations, i.e. in order to prevent the upcoming of discharges or arcs. However, at the same time, there is a need for compact switchgears which require less space, but still with assured safety against disruptive discharge.

An object of the present invention is to provide a switchgear which has a compact design.

A further object of the present invention is to provide a reduced risk of flashover, discharges or arcing between components or units of a switchgear.

The above-mentioned objects of the present invention are attained by providing a switching device for electric power distribution, electrically connectable to an electrical conductor, the switching device comprising

- a breaker electrically connectable to the electrical conductor, and an at least partially electrically conductive housing to which the breaker is mounted, the housing having an outer surface, the breaker comprising at least one electrically conductive first contact and one electrically conductive second contact, the second contact being movable and in relation to the first contact and in relation to the housing, and when the first and second contacts are in contact the breaker is in a closed position, and when the first and second contacts are separated the breaker is in an open position, the switching device being arranged to provide a current path between the breaker and the electrical conductor, and the housing houses at least one guiding member for operating the second contact, the at least one guiding member being movable in relation to the housing, wherein the at least one guiding member comprises a biasing assembly arranged to bias the second contact against the first contact when the breaker is in the closed position, and wherein the biasing assembly comprises a plurality of biasing members comprising a first biasing member and a second biasing member.

By means of the switching device according to the present invention, having a biasing assembly comprises a plurality of biasing members, the compactness of the biasing assembly is improved, and consequently, the compactness of the switching device and the switchgear is improved, while still providing a reduced risk of flashover, discharges or arcing between components or units of a switchgear. Especially, when installed, the vertical extension of the switching device and the switchgear may be efficiently reduced, providing an efficient compactness, since the extension of the switching device in the direction of movement of the second contact may reduced by the biasing assembly and the plurality of biasing members. By having two, or a plurality of, biasing members instead of a single biasing member, the extension of the biasing assembly may be reduced without reducing the biasing effect of the biasing assembly, and the biasing assembly is given a more compact size, allowing the housing to be more compact in size, and consequently, the compactness of the switching device and the switchgear is improved. The switching device may be used for a plurality of different applications, e.g. for both a load break switch application and a circuit breaker application, without any, or at least without any substantial, design alterations. The switching device is easy to assemble and install and may be assembled, pre-assembled, before arriving on the operation site. The biasing assembly is easy to assemble and install and may be assembled, pre-assembled, before arriving on the operation site, which facilitates the installation work.

The first biasing member and the second biasing member may be located laterally next to one another. The first biasing member may be in the form a first resilient member and the second biasing member may be in the form of a second resilient member. The first biasing member may comprise a first compression spring, e.g. a coil spring, and the second biasing member may comprise a second compression spring, e.g. a coil spring. The plurality of biasing members may comprise a first additional biasing member and a second additional biasing member. The first additional biasing member may extend axially inside the first biasing member, and the second additional biasing member may extend axially inside the second biasing member. The housing may house a first part of the current path between the breaker and the electrical conductor, the first part of the current path being electrically connected to the breaker.

The breaker is adapted to open/interrupt the current path and adapted to close the current path. There are several prior art breakers well known to the person skilled in the art. A breaker has at least two states. A first state, which is a closed or conductive state, in which it conducts current through it, and a second state, which is an open or non-conductive state, in which it breaks/interrupts the current path through it and in which it is substantially non-conductive and does not conduct any current. Conventionally, a breaker is adapted to detect a fault condition and break the current upon fault detection, and thereafter, the breaker may be reset (manually or automatically) to resume normal conducting operation.

The breaker may be electrically connectable to an electrical conductor located outside of the housing.

According to a further advantageous embodiment of the switching device according to the present invention, the breaker is a vacuum interrupter, but the breaker can be in the form of any suitable type of breaker, such as a $SF_6$ gas interrupter.

According to an advantageous embodiment of the switching device according to the present invention, the switching device comprises the electrical conductor.

Advantageously, the electrical conductor is a busbar, but can also be in the form of any other the electrical conductor. Advantageously, the housing is made of a suitable electrically conductive material, e.g. aluminium, such as cast aluminium. However, the housing can also be made of copper, zinc, a conductive polymer material, or any other suitable electrically conductive material. Casting, or moulding, an aluminium housing is a non-expensive procedure. Advantageously, the housing is plated with nickel or silver at certain locations, e.g. at electric connection areas.

Advantageously, the major or greater part of the breaker may be located outside of the housing. Advantageously, the at least partially electrically conductive housing is electrically conductive.

The housing may comprise an opening, e.g. a slot, for receiving at least a portion of the switch element.

As a result of the improved switching device, the need of electrically insulating gas inside an encapsulation in which a switching device is housed may be reduced, and possibly air instead of, for example, $SF_6$, may be used. However, the switching device of the present invention can advantageously be combined with encapsulations containing any insulating gas, e.g. $SF_6$, and the housing of the switching device may also be filled with, or contain, any insulating gas.

According to an advantageous embodiment of the switching device according to the present invention, the second contact is axially movable along a first axis, and the first biasing member is radially displaced from the second biasing member in relation to the first axis. By means of this embodiment, the extension of the biasing assembly is further reduced without reducing the biasing effect of the biasing assembly, and the biasing assembly and the housing are given a more compact size, and consequently, the compactness of the switching device and the switchgear is improved.

According to a further advantageous embodiment of the switching device according to the present invention, the first biasing member is radially separated from the second biasing member in relation to the first axis. By means of this embodiment, the extension of the biasing assembly is further reduced without reducing the biasing effect of the biasing assembly, and consequently, the compactness of the switching device and the switchgear is improved.

According to another advantageous embodiment of the switching device according to the present invention, the biasing assembly is movable in the direction of the first axis, and the biasing assembly is indirectly or directly connected to the second contact. By means of this embodiment, a switchgear having a compact design is provided. The biasing assembly may be connected to, but electrically insulted from, the second contact.

According to yet another advantageous embodiment of the switching device according to the present invention, the at least one guiding member comprises at least one pivoting arm rotatable about a pivot axis, the pivoting arm and the biasing assembly comprise complementary guiding means for transferring rotary movement of the pivoting arm to axial movement of the biasing assembly, and the pivoting arm is arranged to control the axial movement of the biasing assembly and of the second contact. By means of this embodiment, the compactness of the switching device and the switchgear is further improved.

According to a further advantageous embodiment of the switching device according to the present invention, the switching device comprises second complementary guiding means for guiding the biasing assembly in a linear direction. By means of this embodiment, an efficient control of the second contact is provided, and the linear movement of the second contact is assured to provide a satisfactory contact between the first and second contacts of the breaker. The second complementary guiding means may be arranged to guide the biasing assembly along a second axis which is substantially parallel to, or substantially collinear with, the first axis.

According to still another advantageous embodiment of the switching device according to the present invention, the pivot axis is substantially perpendicular to the first axis. By means of this embodiment, the compactness of the switching device and the switchgear is yet further improved.

According to an advantageous embodiment of the switching device according to the present invention, the first biasing member comprises a first compression spring and the second biasing member comprises a second compression spring, the first compression spring defines a first longitudinal central axis and the second compression spring defines a second longitudinal central axis, and the first central axis is displaced from the second central axis. By means of this embodiment, the extension of the biasing assembly is further reduced without reducing the biasing effect of the biasing assembly, and the biasing assembly and the housing are given a more compact size, and consequently, the compactness of the switching device and the switchgear is further improved. Each compression spring may be in the form of a coil spring or a helical spring. Alternatively, each biasing member may comprise any other suitable biasing means, e.g. a dish spring, a flat spring, a leaf spring, a torsion spring etc.

According to a further advantageous embodiment of the switching device according to the present invention, the first central axis is radially displaced from and substantially parallel to the second central axis. By means of this embodiment, the extension of the biasing assembly is further reduced, providing an improved compactness of the switching device and the switchgear, while still providing a reduced risk of flashover, discharges or arcing between components or units of a switchgear.

According to another advantageous embodiment of the switching device according to the present invention, the biasing assembly comprises a biasing assembly casing which houses the plurality of biasing members. The biasing assembly and the biasing assembly casing, as being part of the at least one guiding member, are housed in the housing. The biasing assembly casing may be given a specific weight, and the weight of the biasing assembly casing may be easily adjusted, by exchanging the biasing assembly casing for a heavier or lighter one, in order to adjust and control the movement, velocity and acceleration of the biasing assembly, and consequently also to adjust and control the movement, velocity and acceleration of the second contact. By means of the biasing assembly housing, the opening action of the breaker, i.e. when the first and second contacts are separated, may be adjusted to specific applications, providing a flexible and improved switching device. By means of the biasing assembly housing, an improved compactness of the switching device and the switchgear is provided, while still providing a reduced risk of flashover, discharges or arcing between components or units of a switchgear.

The biasing assembly may comprise one or a plurality additional biasing members of any of the sorts mentioned in connection with the first and second biasing members. The biasing assembly casing may house the additional biasing members. By means of the biasing assembly casing, the biasing effect may be readily adjusted by adding or removing additional biasing members to/from the biasing assembly casing, or even exchange the first and second biasing members.

According to still another advantageous embodiment of the switching device according to the present invention, the biasing assembly casing comprises a first compartment and a second compartment, and the first compartment houses the first biasing member and the second compartment houses the second biasing member. By means of this embodiment, the extension of the biasing assembly is further reduced, providing an improved compactness of the switching device and the switchgear, while still providing a reduced risk of flashover, discharges or arcing between components or units of a switchgear.

According to yet another advantageous embodiment of the switching device according to the present invention, the biasing assembly casing is made of at least one cast part. This is an efficient way to provide a biasing assembly casing having a specific weight to improve the operation of the second contact of the switching device.

According to an advantageous embodiment of the switching device according to the present invention, the breaker is held by a cylindrical container which engages the housing. The container may be made of a polymer material, e.g. a thermoplastic material. The container may house the breaker. By this embedment, the compactness of the switchgear is further improved, and the risk of flashover, discharges or arcing between components or units of the switchgear is further reduced.

According to an advantageous embodiment of the switching device according to the present invention, the housing is provided with a through-hole for suspension of the housing. Hereby, an efficient suspension of the housing is provided which does not impair the distribution of the electric field to any substantial extent. The housing may comprise annular electrically insulating elements around the entrance and exit of the through-hole to further reduce the risk of flashover, discharges or arcing between components or units of a switchgear.

According to a further advantageous embodiment of the switching device according to the present invention, the outer surface of the housing is smoothly curved towards and into the through-hole. By means of this embodiment, a so called triple point with high dielectric stress may be avoided. This is advantageous when using a shaft which is inserted into the through-hole.

According to another advantageous embodiment of the switching device according to the present invention, the switching device comprises a shaft inserted into the through-hole of the housing, wherein the shaft is rotatable about its longitudinal axis and in relation to the housing, wherein the shaft is connected to the at least one guiding member, and wherein the shaft and its rotation is adapted to control the movement of the at least one guiding member. By means of this embodiment, an efficient control of the breaker is provided, which does not impair the distribution of the electric field to any substantial extent. Advantageously, when each of a plurality of phases, e.g. three phases, is provided with the innovative switching device, the same shaft may be inserted into the through-hole of each housing to control the movement of the at least one guiding member of all the housings. Alternatively, instead of using said shaft to operate the breaker, two pulling/pushing rods may be used, one for opening the breaker and one for closing the breaker. Other means for controlling the breaker are also possible. The shaft may be connected to the pivoting arm. The shaft may be connected to each through-hole and housing by means of bearing means, e.g. at least one bearing.

According to still another advantageous embodiment of the switching device according to the present invention, the housing is made of at least one cast part. Advantageously, the housing can be made of two cast parts which are joined by suitable means. By means of these embodiments, the breaker will be efficiently supported, and a mechanically stable switching device and system are attained.

According to yet another advantageous embodiment of the switching device according to the present invention, the housing is adapted to be at an electric potential which is substantially equal to the electric potential of the second contact of the breaker during the operation of the switching device. By means of this embodiment, the distribution of the electric field and the electric field stress is further improved.

According to yet another advantageous embodiment of the switching device according to the present invention, the housing has a smooth outer shape to distribute the electric field generated by the voltage of the current through the switching device. The outer shape, or the outer geometry, of the housing is smooth in that the housing does not have an angular outer shape, e.g. with sharp corners or edges, and is without roughness. By this embodiment, the electric field, or electric field stress, generated by the voltage of the current through the switching device is further evenly distributed in an efficient way, and the risk of flashover, discharges or arcing between the components of the switching device and between the housing and the surroundings, e.g. the housing of a switching device of another phase, or ground, is further reduced. As a result, the switchgear provided with one or a plurality of the switching devices according to the present invention can be made more compact and less bulky, and less space for the switchgear is needed. Further, any additional shielding of the electric field is avoided.

According to an advantageous embodiment of the switching device according to the present invention, the housing has an outer surface which is smooth to distribute the electric field generated by the voltage of the current through the switching device. The outer surface of the housing is smooth in that the outer surface has no roughness, projections or sharp indentations. The outer surface is evenly curved. By means of this embodiment, the even distribution of the electric field, or electric field stress, is further improved. The risk of flashover, discharges or arcing between components or units of a switchgear is further reduced, and the switchgear can have a more compact design.

According to an advantageous embodiment of the switching device according to the present invention, the housing houses a first part of the current path between the breaker and the electrical conductor, the first part of the current path being electrically connected to the breaker, wherein the switching device comprises a switch for electrically connecting the breaker to the electrical conductor, and wherein the switch comprises a switch element movable to a first position in which the switch element is electrically connected to the first part of the current path and to the electrical conductor, movable to a second position in which the switch element is disconnected from the electrical conductor and electrically connected to the first part of the current path and to a grounded element, and movable to a third position in which the switch element is disconnected from the electrical conductor and from the grounded element.

By placing the first part of the current path, to which the switch element is electrically connected (i.e. in conductive contact) in the first and second positions, within the housing so that the first part of the current path is housed in the housing, the outer surface of the housing may be given a particularly smooth outer shape. Consequently, the electric field, or electric field stress, generated by the voltage of the current through the switching device is evenly distributed in an efficient way, and the risk of flashover, discharges or arcing between the components of the switching device and between the housing and the surroundings, e.g. the housing of a switching device of another phase, or ground, is efficiently reduced. As a result, the switchgear provided with one or a plurality of the switching devices according to the present invention can be made more compact and less bulky, and less space for the switchgear is thus needed. Further, any additional shielding of the electric field may be avoided. The provision of the at least one guiding member for operating the breaker inside the housing also contributes to an even distribution of the electric field.

In the second position the switch element may be electrically connectable to a grounded element located outside of the housing.

According to a further advantageous embodiment of the switching device according to the present invention, in the first position the switch element is electrically connectable to an electrical conductor located outside of the housing. By means of this embodiment, the compactness of the switchgear is further improved.

According to another advantageous embodiment of the switching device according to the present invention, in the third position the switch element is situated within the outer surface of the housing. By means of this embodiment, the switch element may be completely shielded by the housing. The dielectric performance of the switching device is not impaired, and the distribution of the electric field and of the electric field stress is further improved. Further, the compactness of the switchgear may be further improved.

According to still another advantageous embodiment of the switching device according to the present invention, in the third position the switch element is electrically connected to the first part of the current path. By means of this embodiment, the distribution of the electric field and of the electric field stress and the compactness of the switchgear are further improved.

According to yet another advantageous embodiment of the switching device according to the present invention, the switch element is pivotable about an axis of rotation and pivotable between the first, second and third positions. This is an efficient way of moving the switch element between its different positions, which supports the compact design of the switchgear.

According to an advantageous embodiment of the switching device according to the present invention, the axis of rotation of the switch element is located outside of the outer surface of the housing. By means of this embodiment, the switch element may be pivotally mounted to its axis of rotation outside the housing, and the distribution of the electric field and of the electric field stress is further improved. Alternatively, the axis of rotation of the switch element is located inside of the outer surface of the housing.

According to another advantageous embodiment of the switching device according to the present invention, the axis of rotation of the switch element is located outside of the switch element. This embodiment supports the efficient movement of the switch element between its different positions.

The switch element may have an elongated extension. The switch element may define a longitudinal axis along the elongated extension, and the longitudinal axis of the switch element may be displaced from the axis of rotation of the switch element. Alternatively, the axis of rotation of the switch element may intersect the switch element.

According to still another advantageous embodiment of the switching device according to the present invention, the switch element has a first end portion and a second end portion between which the switch element extends, wherein in the first position the first end portion of the switch element is electrically connected to the first part of the current path and the second end portion of the switch element is electrically connected to the electrical conductor, and in the second position the second end portion of the switch element is disconnected from the electrical conductor and electrically connected to the first part of the current path and the first end portion of the switch element is electrically connected to the grounded element. By means of this embodiment, the distribution of the electric field and of the electric field stress and the compactness of the switchgear are further improved.

According to yet another advantageous embodiment of the switching device according to the present invention, in the third position the first and second end portions of the switch element are electrically connected to the first part of the current path. By means of this embodiment, the distribution of the electric field and of the electric field stress and the compactness of the switchgear are further improved.

According to an advantageous embodiment of the switching device according to the present invention, the switching device comprises an electrically conductive member which forms the first part of the current path between the breaker and the electrical conductor, wherein the housing houses the conductive member.

According to a further advantageous embodiment of the switching device according to the present invention, the conductive member has a first end portion and a second end portion between which the conductive member extends, wherein in the first position the switch element is electrically connected to the second end portion of the conductive member, and in the second position the switch element is electrically connected to the first end portion of the conductive member. This embodiment supports the efficient movement of the switch element between its different positions.

According to another advantageous embodiment of the switching device according to the present invention, in the third position the switch element is electrically connected to the first and second end portions of the conductive member. By means of this embodiment, the distribution of the electric field and of the electric field stress and the compactness of the switchgear are further improved.

The switch element may comprise two switch knives, which may be substantially parallel. When the switch element is connected to the conductive member, the conductive member may be sandwiched between the two switch knives, to improve the contact between the conductive member and the switch element. Advantageously, the conductive member may have an intermediate portion between the first and second end portions, and the thickness of the first and second end portions may be greater than the thickness of the intermediate portion. This embodiment supports the efficient movement of the switch element between its different positions, and supports the connection between the switch element and the conductive member.

According to still another advantageous embodiment of the switching device according to the present invention, the switching device comprises a flexible second electrical conductor electrically connecting the conductive member to the second contact. By means of this embodiment, the distribution of the electric field and of the electric field stress and the compactness of the switchgear are further improved.

The above-mentioned objects of the present invention are also attained by providing a switchgear for electric power distribution, wherein the switchgear comprising at least one switching device according to the present invention, a switchgear having both a compact design and a reduced risk of flashover, discharges or arcing between components or units of a switchgear is attained. Otherwise, an improved switchgear is provided for reasons stated above in connection with the disclosure of the various embodiments of the switching device according to the present invention.

According to an advantageous embodiment of the switchgear according to the present invention, the switchgear comprises an encapsulation housing the at least one switching device.

According to a further advantageous embodiment of the switchgear according to the present invention, the switchgear comprises such a switching device for each phase.

The switching device and/or the switchgear according to the present invention is/are advantageously adapted for medium and/or high voltage, e.g. 1 kV and above.

The above-mentioned embodiments and features of the switching device and the switchgear, respectively, according to the present invention may be combined in various possible ways providing further advantageous embodiments.

Further advantageous embodiments of the switching device and the switchgear according to the present invention and further advantages with the present invention emerge from the detailed description of embodiments.

BRIEF DESCRIPTION OF THE DRAWINGS

The present invention will now be described, for exemplary purposes, in more detail by way of embodiments and with reference to the enclosed drawings, in which.

DETAILED DESCRIPTION OF THE INVENTION

Figure 1:
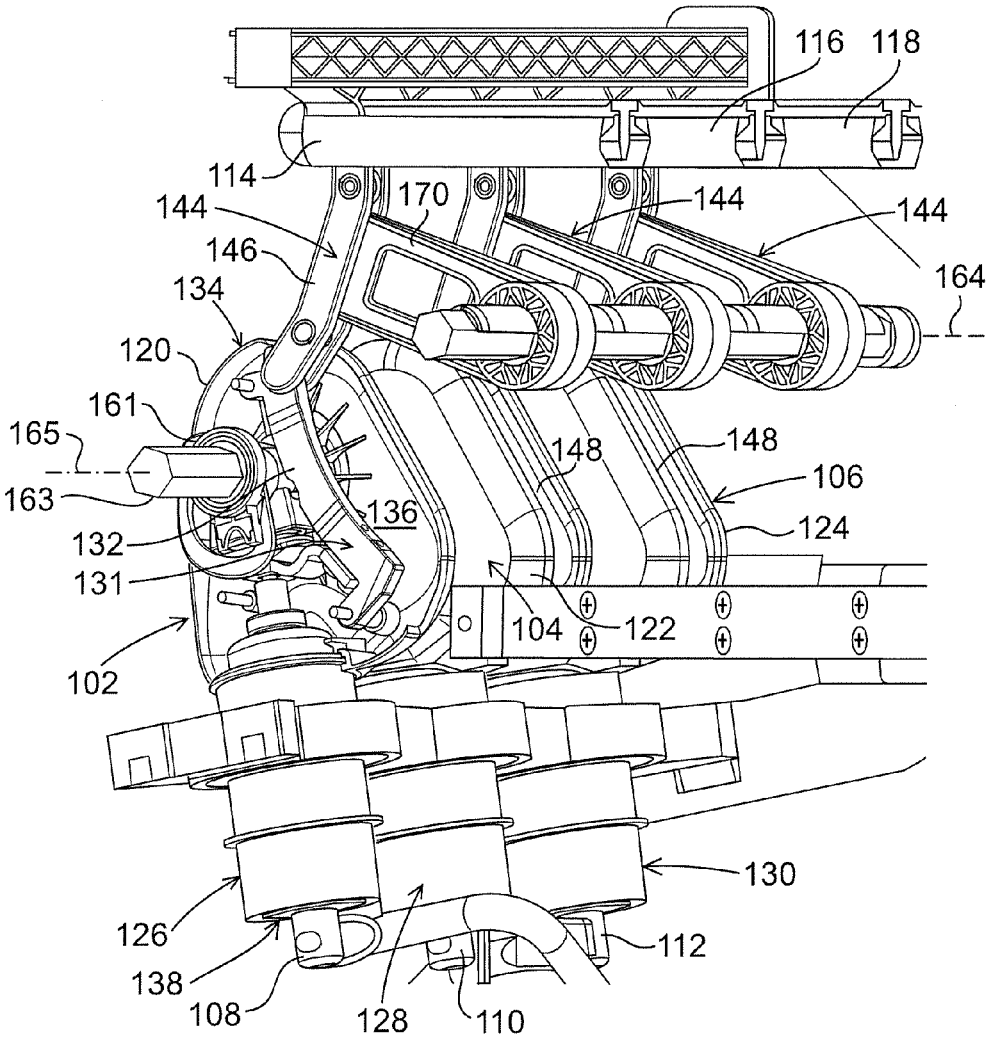
FIG. 1 is a schematic partial view of an embodiment of the switchgear according to the present including three embodiments of the switching device according to the present invention.

FIG. 1 schematically shows an embodiment of the switchgear according to the present having three embodiments of the switching device 102, 104, 106 for electric power distribution according to the present invention, where one of the switching devices 102 has a part of the housing cut away for illustrative purposes. The shown switchgear is an electric power distribution switchgear and comprises a plurality of switching devices 102, 104, 106 which can be housed in an encapsulation 107 (see FIG. 5). The encapsulation 107 may be penetrated by a number of electrical bushings (not shown), one for each phase of a plural phase system. From each electrical bushing a respective conducting element 108, 110, 112 may extend to the respective switching device 102, 104, 106. On the outside of the encapsulation 107, the electrical bushings may be connected to cables (not shown) which either connect the switchgear to a load or to a medium or high voltage power distribution line.

Each switching device 102, 104, 106 is electrically connectable to an electrical conductor 114, 116, 118, in the form of a busbar. Each switching device 102, 104, 106 comprises an electrically conductive housing 120, 122, 124, which may be made of metal, e.g. aluminium, or any other suitable metal, and may be made of two cast parts, and a breaker 126, 128, 130 mounted to the housing 120, 122, 124. The housing 120, 122, 124 may overlap a part of the breaker 126, 128, 130. The greater part of the breaker 126, 128, 130 is located outside of the housing 120, 122, 124. The breaker 126 may be held by a cylindrical container 129 which engages the housing 120 (see FIG. 6). The switching device 102, 104, 106 provides a current path between the breaker 126, 128, 130 and the electrical conductor 114, 116, 118. The housing 120 houses a first part 131 of the current path between the breaker 126 and the electrical conductor 114. The first part 131 of the current path is electrically connected to the breaker 126.

Each housing 120 has an outer surface 134 and an inner surface 136. The outer shape, or the outer geometry, of the housing 120, 122, 124 may be smooth to distribute the electric field generated by the voltage of the current through the switching device 102, 104, 106. The outer shape of the housing 120 is smooth in that the housing does not have an angular outer shape and is without roughness (see FIG. 5). The outer surface 134 of the housing 120 may also be smooth to distribute the electric field generated by the voltage of the current through the switching device 102, 104, 106. The outer surface 134 of the housing 120 is smooth in that the outer surface 134 has no roughness, sharp projections or sharp indentations. Each housing 120 may be made of at least one cast part, e.g. two cast parts mounted to one another.

The breaker 126, 128, 130 is in the form of a vacuum interrupter and includes in a conventional way an electrically conductive first contact 202 (schematically illustrated by broken/dashed lines in FIG. 6) electrically connected to a first terminal 138 and an electrically conductive second contact 204 (schematically illustrated by broken lines in FIG. 6) electrically connected to a second terminal 140. The second contact 204 and the second terminal 140 are movable in relation to the first contact 202 and in relation to the housing 120. When the first and second contacts 202, 204 are in contact the breaker 126 is in a closed (conducting) position, and when the first and second contacts 202, 204 are separated the breaker 126 is in an open (non-conducting) position. The breaker 126, 128, 130 is conventional and known to the skilled person and is therefore not described in more detail. It is to be understood that other breakers instead of the vacuum interrupter may also be used.

The above-mentioned first part 131 of the current path may be in the form of an electrically conductive member 132 which forms the first part 131 of the current path between the breaker 126 and the electrical conductor 114. With reference to FIGS. 2-4 and FIG. 6, the conductive member 132 may be mounted to the inner surface 136 of the housing 120. The conductive member 132 may be electrically connected to the second contact 204 of the breaker 126 by being connected to the second terminal 140 by means of a flexible second electrical conductor 142 electrically connecting the conductive member 132 to the second contact 204 (see FIG. 6). The conductive member 132 is electrically connectable to the electrical conductor 114 by means of a switch 144 for electrically connecting the breaker 126 to the electrical conductor 114. The switch 144 comprises an electrically conductive switch element 146. The second electrical conductor 142 and the switch element 146 may form a second part of the current path between the breaker 126 and the electrical conductor 114. Each housing 120, 122, 124 may comprise an opening 148, e.g. a slot, for receiving at least a portion of the switch element 146, to allow the switch element 146 to make contact with the conductive member 132 housed in the housing 120 (see FIG. 1). The switch element 146 may be adapted to move in the opening 148 provided in the housing 120. The conductive member 132 and the switch 144 are described in further detail herein below.

Figure 6:
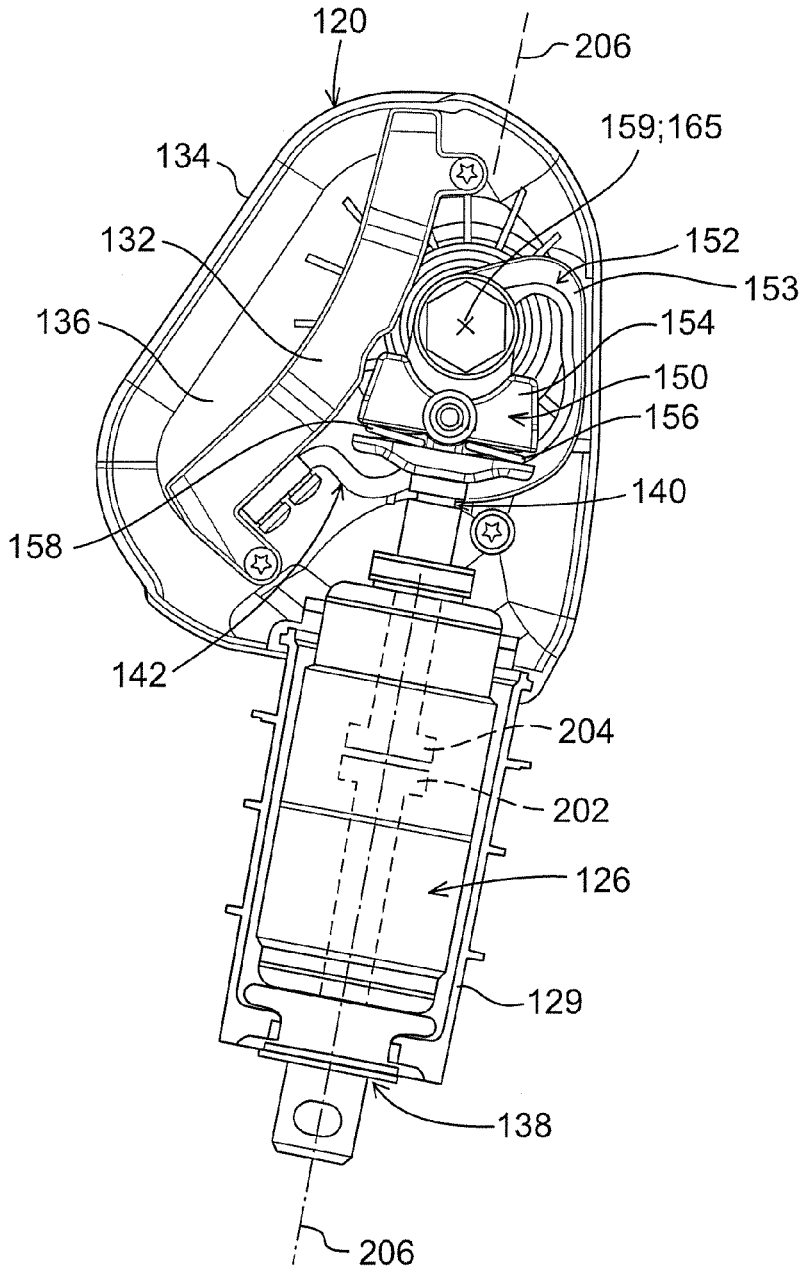
FIG. 6 is a schematic cutaway view of the embodiment of the switching device showing the at least one guiding member for operating the breaker.
Figure 7:
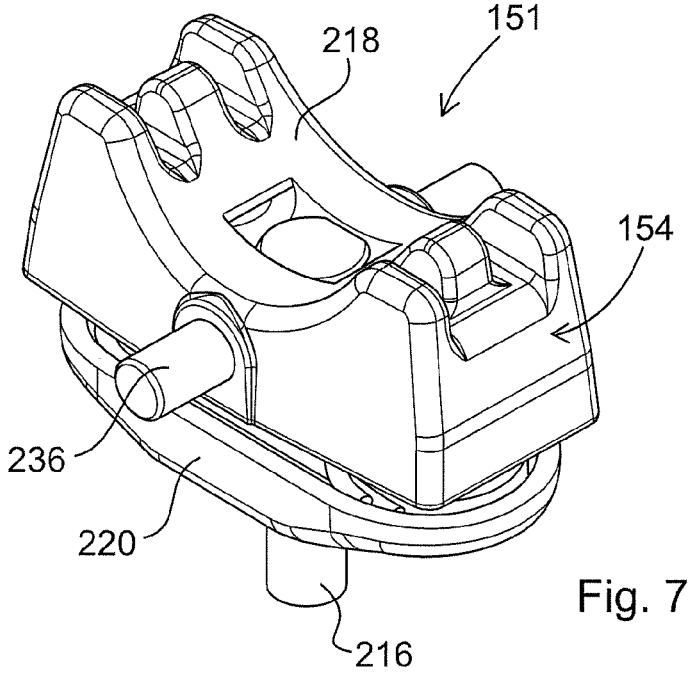
FIGS. 7-10 are schematic views of the biasing assembly shown in FIG. 6.
Figure 8:
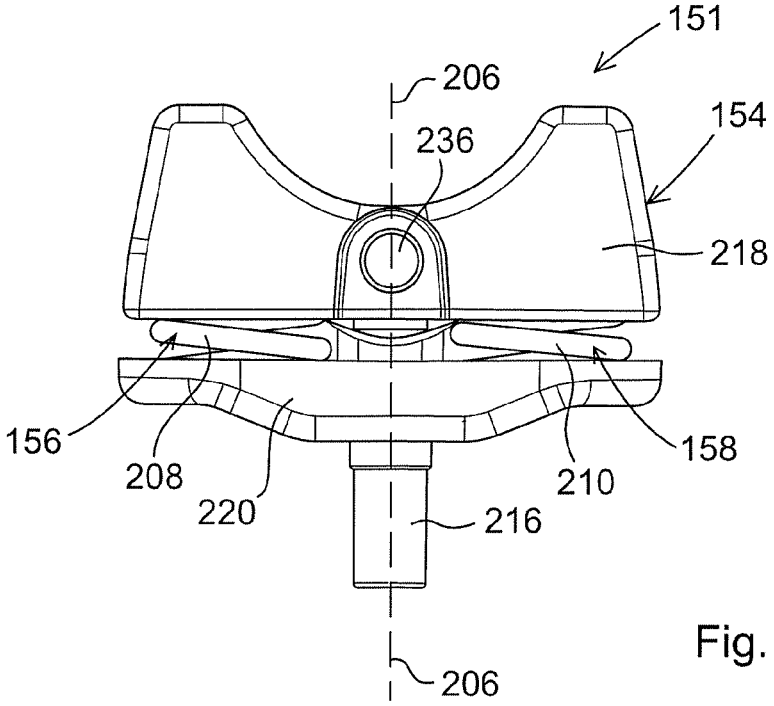
Figure 9:
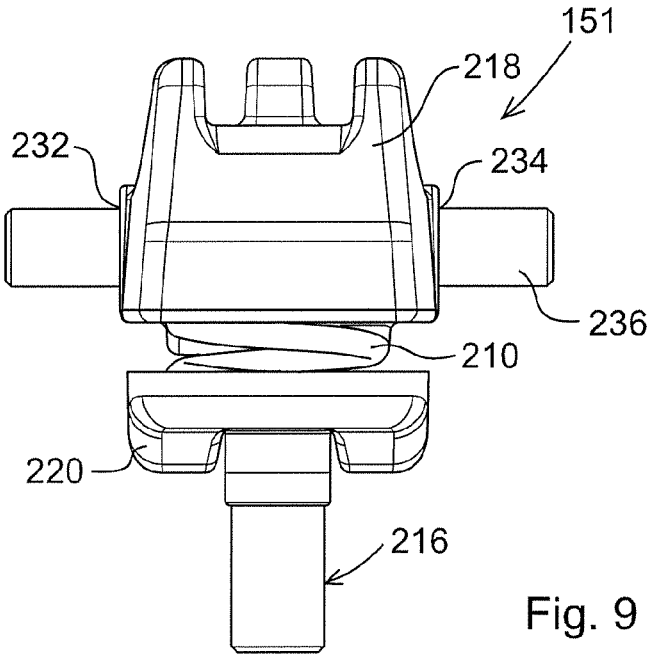

With reference to FIG. 6, the housing 120 may house a plurality of guiding members 150, 152 for operating the breaker 126. The plurality of guiding members 150, 152 may comprise a first group 150 of guiding members forming a biasing assembly 151. The biasing assembly 151 may comprise a biasing assembly casing 154 housing a plurality of basing, and/or resilient, members 156, 158. The biasing assembly 151 may also be designed in other ways and may be in the form of a single biasing member, e.g. a coil spring, or any other spring means, e.g. a dish spring etc. The biasing assembly 151 may be connected to, but electrically insulated from, the second contact 204 of the breaker 126. The biasing assembly 151 is adapted to bias the second contact 204 against the first contact 202, when the breaker 126 is in the closed position. The biasing assembly 151 may be axially movable in relation to the housing 120. The second contact 204 may be axially movable along a first axis 206. Further, the plurality of guiding members 150, 152 may comprise a pivoting arm 153 which is rotatable about a pivot axis 159. The biasing assembly 151 is connected to the pivoting arm 153, and the rotation of the pivoting arm 153 effects the axial movement of the biasing assembly 151. The axial movement of the biasing assembly 151 effects the axial movement of the second contact 204 of the breaker 126.

Figure 10:
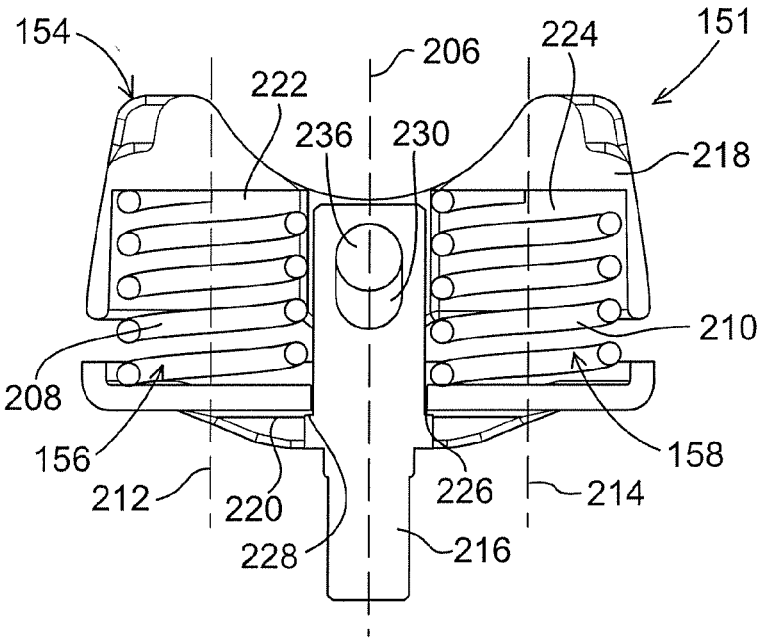

With reference to FIGS. 7-10, the biasing assembly 151 shown in FIG. 6 is now described in more detail. The biasing assembly 151 may comprise said plurality of biasing members 156, 158 comprising a first biasing member 156 and a second biasing member 158. The first biasing member 156 may comprise a first compression spring 208 and the second biasing member 158 may comprise a second compression spring 210. Each compression spring 208, 210 may, for example, be in the form of a coil or helical spring. With reference to FIG. 10, showing a cross-section of the biasing assembly 151, the first compression spring 208 may define a first longitudinal central axis 212 and the second compression spring 210 may define a second longitudinal central axis 214. The first biasing member 156 may be radially displaced and radially separated from the second biasing member 158 in relation to the first axis 206. The first central axis 212 may be displaced from the second central axis 214, or more precisely, the first central axis 212 may be radially displaced from and substantially parallel to the second central axis 214.

The biasing assembly 151 may be movable in the direction of the first axis 206, and the biasing assembly 151 may indirectly, or directly, be connected to the second contact 204 via an axially movable guiding rod 216, which may be arranged to electrically insulate the biasing assembly 151 from the second terminal 140 and from the second contact 204 of the breaker 126.

The biasing assembly casing 154, which houses the plurality of biasing members 156, 158, may comprise a first casing part 218 and a second casing part 220. With reference to FIG. 10, showing a cross-section of the biasing assembly 151, the first casing part 218 may comprise a first compartment 222 and a second compartment 224, where the first compartment 222 houses the first biasing member 156, and the second compartment 224 houses the second biasing member 158. Each casing part 218, 220 may be made of a cast part. The second casing part 220 may be provided with a first opening 226 engaged by the guiding rod 216, and the guiding rod 216 may hold the second casing part 220 in place by means of a shoulder 228. The guiding rod 216 may comprise a second opening 230, and the first casing part 218 may comprise two third openings 232, 234. The biasing assembly 151 may comprise a guiding pin 236 arranged to engage the second and third openings 230, 232, 234 to lock the biasing assembly 151 to the guiding rod 216.

The biasing assembly 151 may comprise one or a plurality additional biasing members of any of the sorts mentioned in connection with the first and second biasing members. The biasing assembly casing 154 may house the additional biasing members. One additional biasing member may, for example, be housed in the first compartment 222 inside of the first biasing member 156, and a second additional biasing member may, for example, be housed in the second compartment 224 inside of the second biasing member 158. By means of the biasing assembly casing 154, the biasing effect may be readily adjusted by adding or removing additional biasing members, or change the first and second biasing members 156, 158.

With reference to FIGS. 11-14, the pivoting arm 153 and the biasing assembly 151 may comprise complementary guiding means 238 for transferring rotary movement of the pivoting arm 153 to axial movement of the biasing assembly 151, and the pivoting arm 153 may be arranged to control the axial movement of the biasing assembly 151 and thus also the axial movement of the second contact 204. The pivot axis 159 of the pivoting arm 153 may be substantially perpendicular to the first axis 206. The complementary guiding means 238 may comprise a curved groove 240, which is defined and formed by the pivoting arm 153, and a roll 242 attached to the guiding pin 236, where the roll 242 engages the curved groove 240. Alternatively, the roll 242 may be excluded, and the guiding pin 236 by itself may be adapted to engage the curved groove 240. The curved groove 240 and the roll 242 are designed to efficiently transfer the rotary movement of the pivoting arm 153 to axial movement of the biasing assembly 151.

The pivoting arm 153 may comprise two pivoting arm elements 244, 246 each provided with a curved groove 240, 248 as mentioned above, and the biasing assembly 151 may be positioned between the two pivoting arm elements 244, 246. The guiding pin 236 may be provided with two rolls 242, 243 each engaging the curved groove 240, 248 of each pivoting arm element 244, 246.

When the pivoting arm 153 pushes the biasing assembly 151 and the second contact 204 in the direction towards the first contact 202 of the breaker, by transferring rotary movement of the pivoting arm 153 to axial movement of the biasing assembly 151, the curved groove 240 pushes the guiding pin 236, the first casing part 218, the guiding rod 216 and consequently the second contact 202 towards the first contact 202, and at the same time the biasing members 156, 158 bias the guiding rod 216 and the second contact 202 towards the first contact 202.

Figure 11:
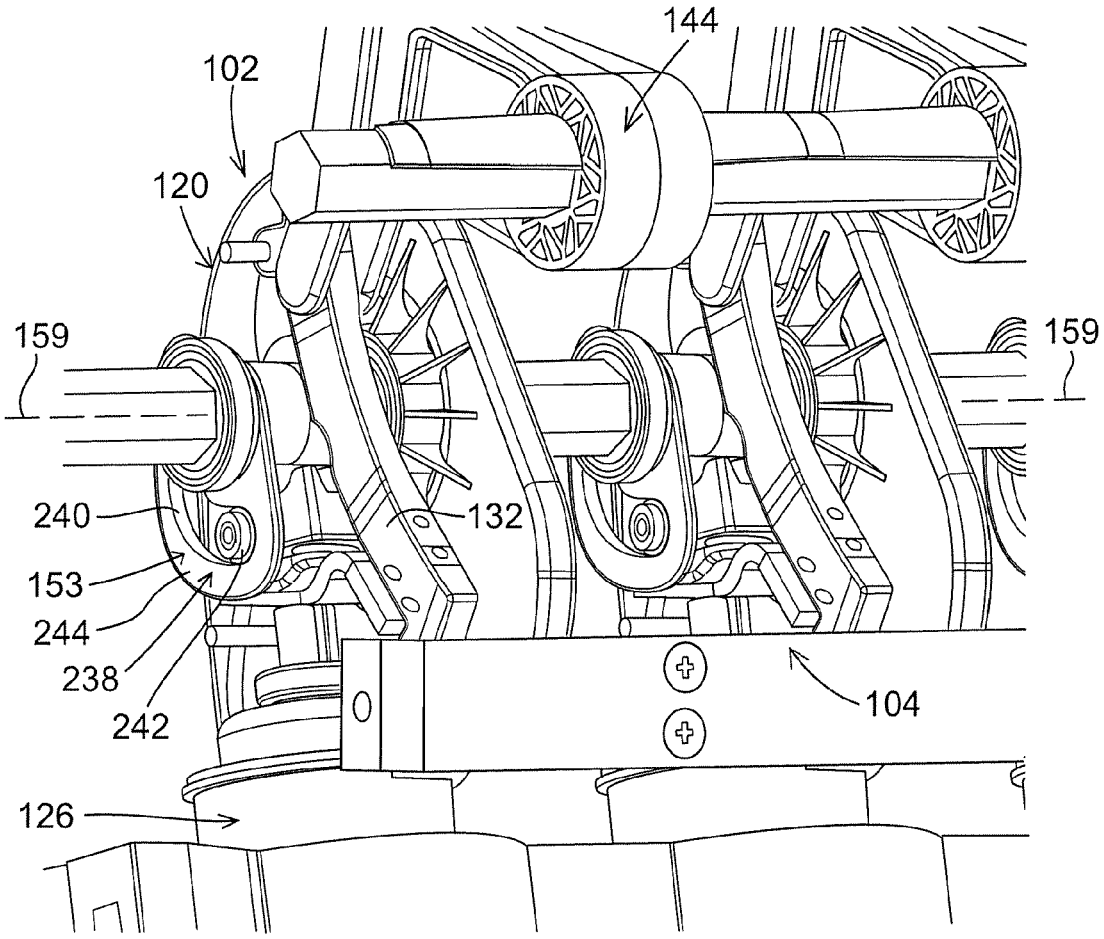
FIGS. 11-14 are schematic cross-section views of the housing, illustrating the at least one guiding member for operating the breaker.
Figure 12:
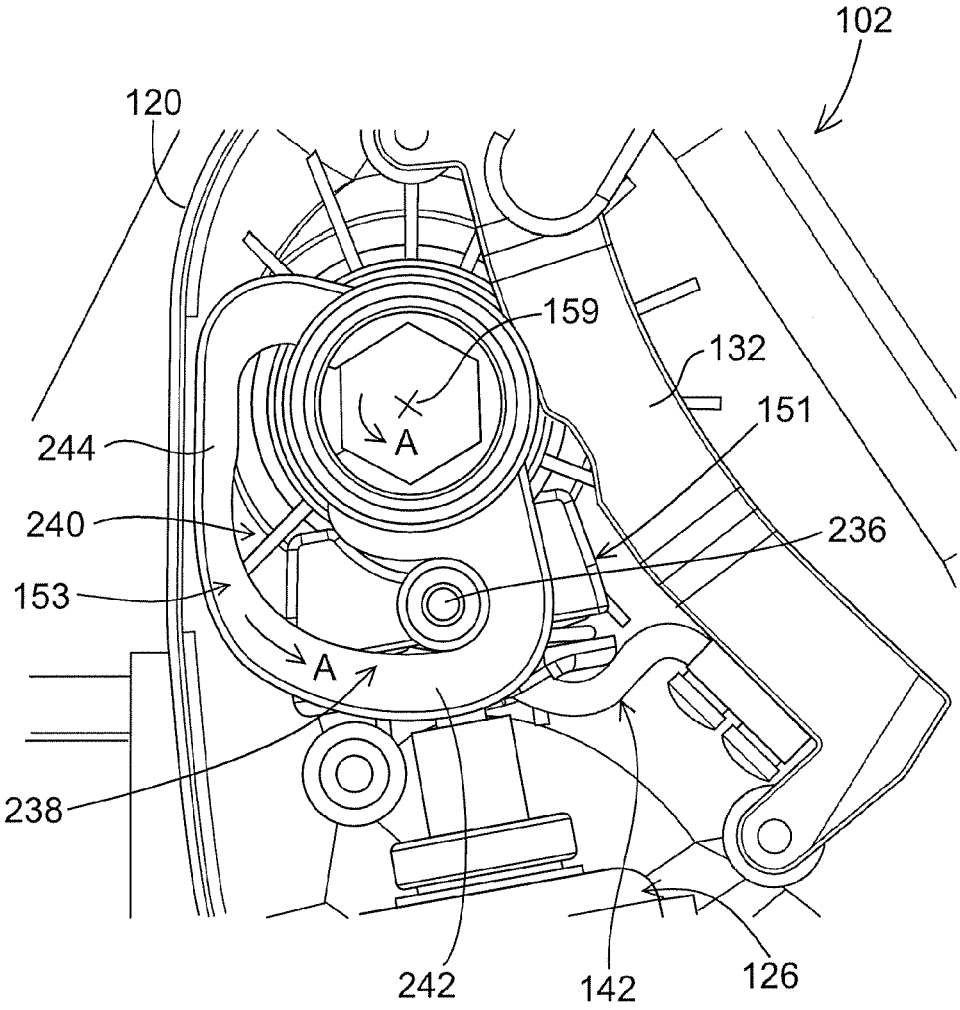
Figure 13:
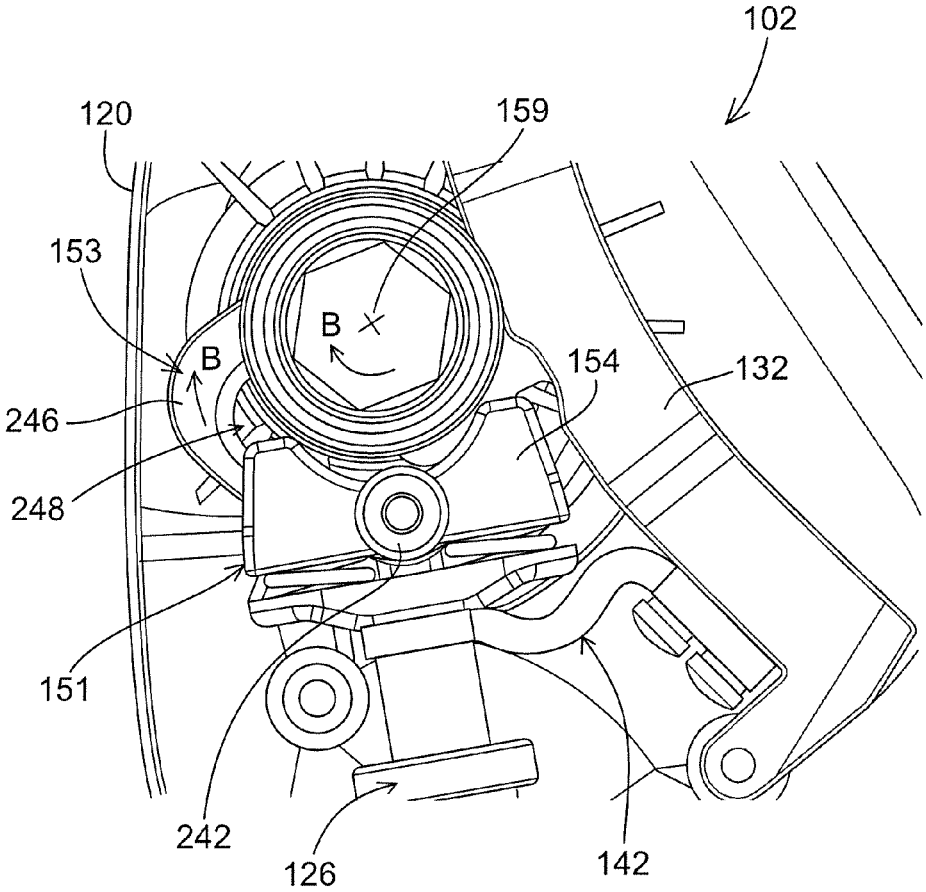
Figure 14:
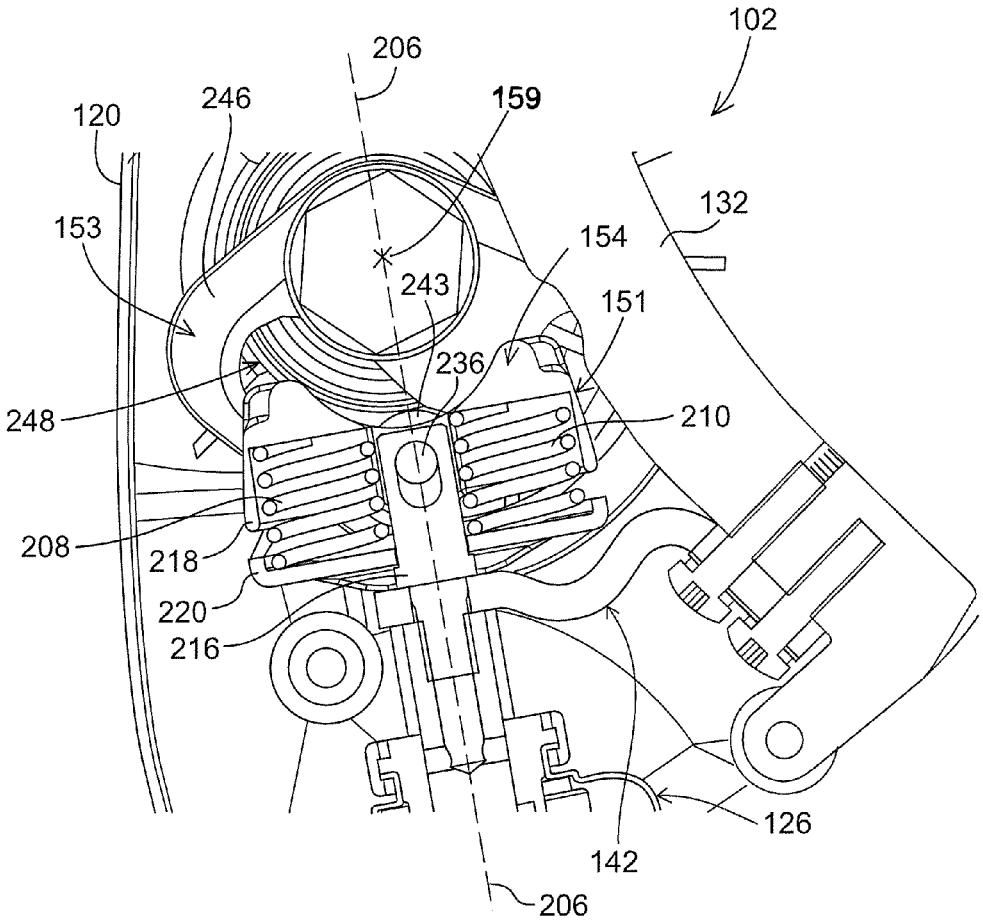

With reference to FIGS. 11-14, the different positions of the at least one guiding member 150, 152 and the second contact 204 of the breaker are shown in more detail. In FIGS. 11-12, the first and second contacts 202, 204 of the breaker 126 are disconnected and separated, i.e. the breaker 126 is in the open position, and the biasing assembly 151 has been moved to a first position remote from the first contact 202. In FIGS. 13-14, the first and second contacts 202, 204 of the breaker 126 are connected, i.e. the breaker 126 is in the closed position, and the biasing assembly 151 has been moved to a second position between its first position and the first contact 202. To move the biasing assembly 151 from the first position, as illustrated in FIGS. 11-12, to the second position as illustrated in FIGS. 13-14, the pivoting arm 153 is rotated in a counter-clockwise direction A illustrated by arrow A in FIG. 12. To move the biasing assembly 151 from the second position, as illustrated in FIGS. 13-14, to the first position as illustrated in FIGS. 11-12, the pivoting arm 153 is rotated in a direction B, as illustrated by arrow B in FIG. 13, opposite to direction A in FIG. 12.

Figure 22:
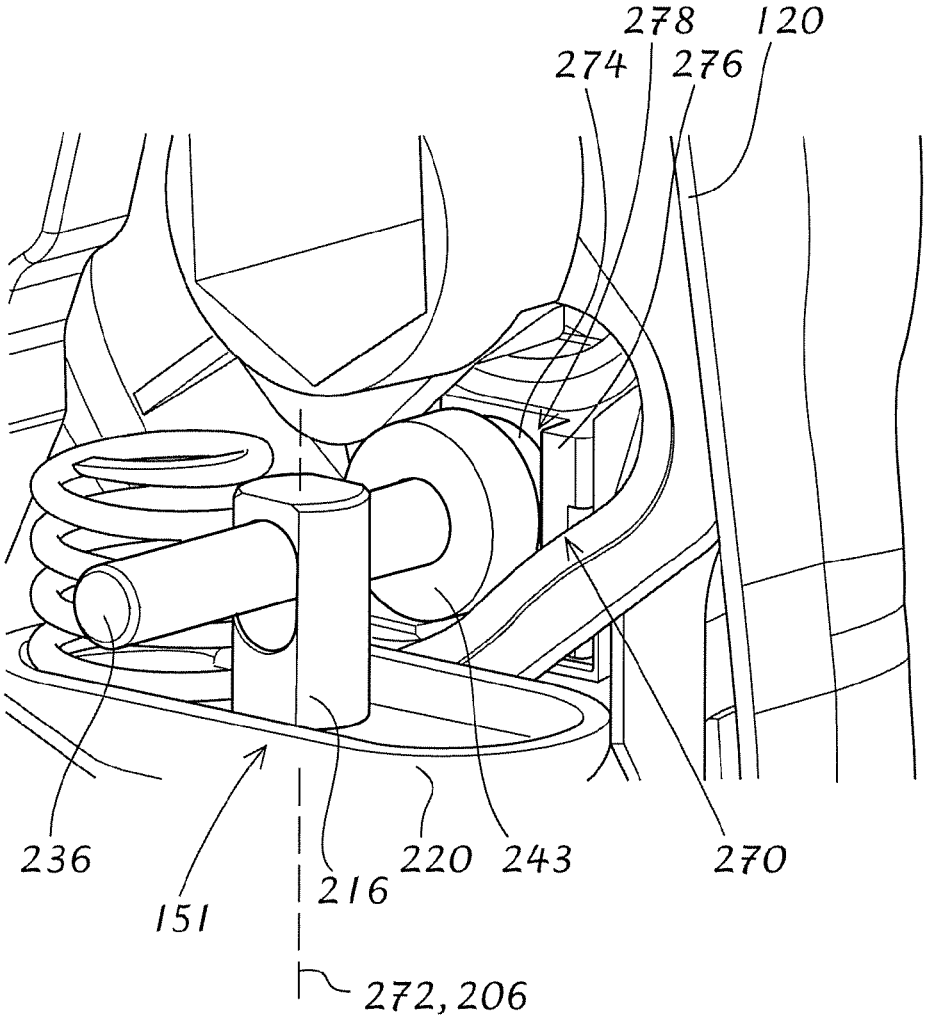
FIG. 22 is a schematic perspective cutaway view illustrating an embodiment of the second complementary guiding means for guiding the biasing assembly in a linear direction.

With reference to FIG. 22, the switching device may comprise second complementary guiding means 270 for guiding the biasing assembly 151 in a linear direction. By means of the second complementary guiding means 270, an efficient control of the second contact 204 is provided, and the linear movement of the second contact 204 is assured, to provide a satisfactory contact between the first and second contacts 202, 204 of the breaker 126. The second complementary guiding means 270 may be arranged to guide the biasing assembly 151 along a second axis 272 which is substantially parallel to, or substantially collinear with, the first axis 206. In FIG. 22, the biasing assembly casing 154 and one of the biasing members have been removed for illustrative purposes. The second complementary guiding means 270 may comprise a first guiding element 274 and a second guiding element 276 provided with an axial groove 278 engaged by the first guiding element 274. The first guiding element 274 may be attached to the biasing assembly 151, for example attached to the guiding pin 236, and the second guiding element 276 may be attached to the housing 120, or vice versa. The axial groove 276 may extend in the direction of the second axis 272.

Figure 5:
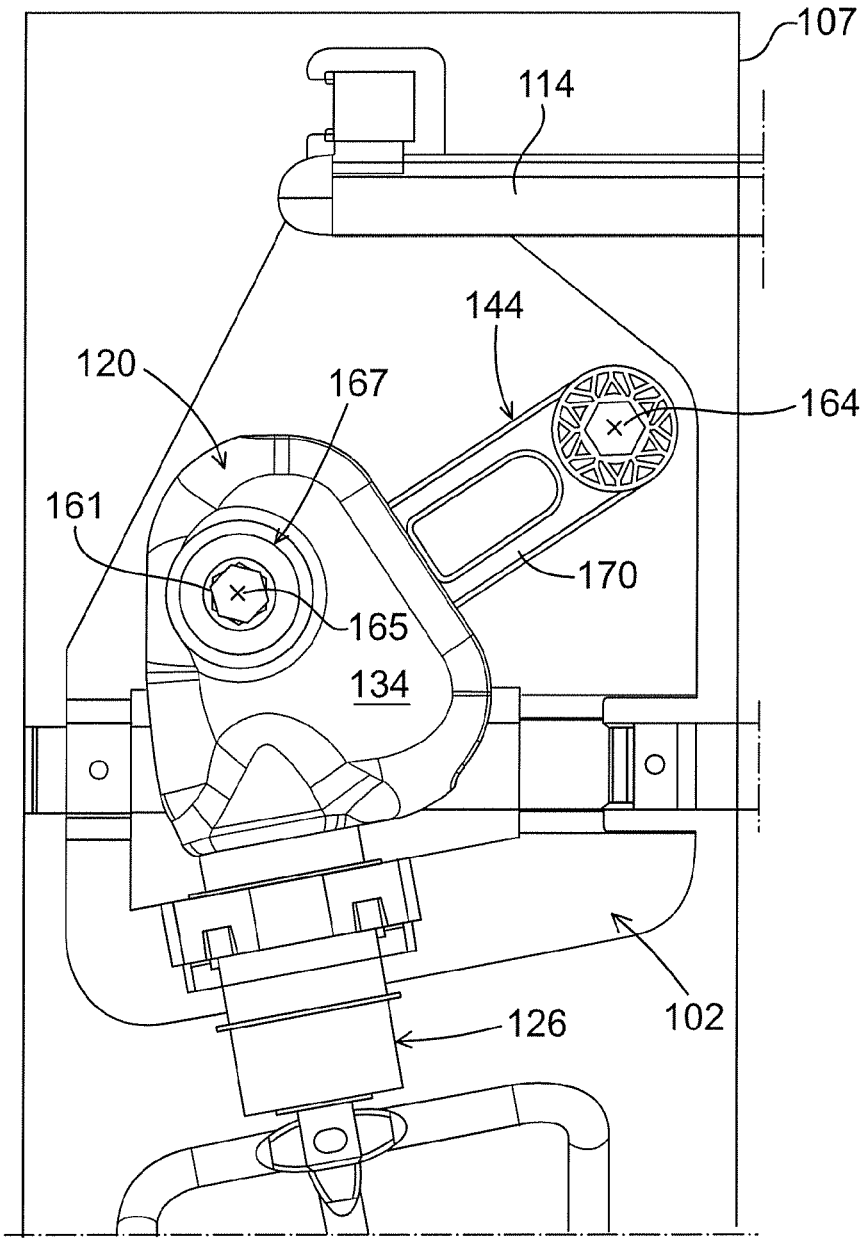
FIG. 5 is a schematic view of the exterior of the housing of the embodiment of the switching device of FIGS. 2-4.
Figure 15:
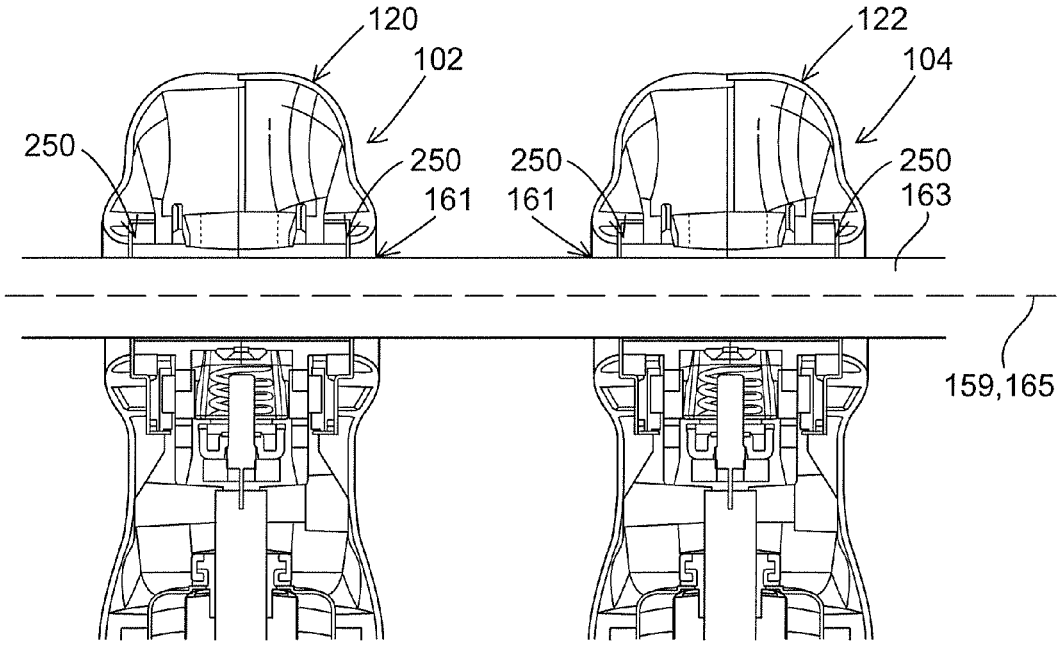
FIG. 15 is a schematic cross-section view of two switching devices shown in FIG. 1.

With reference to FIGS. 1 and 5, each housing 120 may be provided with a through-hole 161 for suspension of the housing 120. A shaft 163 may be inserted into the through-hole 161 of each housing 120. The shaft 163 may be connected to each through-hole 161 and housing 120 by means of bearing means, e.g. at least one bearing. The outer surface 134 of the housing 120 may be smoothly curved towards and into the through-hole 161. By said smooth curvature 167 of the outer surface 134 towards and into the through-hole 161, a so called triple point with high dielectric stress may be avoided. The shaft 163 is rotatable about its longitudinal axis 165 and in relation to the housing 120. The longitudinal axis 165 may be coaxial with the pivot axis 159 of the pivoting arm 153. The shaft 163 may be connected to the pivoting arm 153. The rotation of the shaft 163 causes the pivoting arm 153 to rotate. The shaft 163 is adapted to control the movement of the second contact 204 of the breaker 126 by controlling the rotation of the pivoting arm 153 and thereby controlling the axial movement of the biasing assembly 151. With reference to FIG. 15, schematically showing a schematic cross-section of two switching devices 102, 104, the housing 120, 122 may comprise annular electrically insulating elements 250 around the entrance and exit of the through-hole 161, e.g. one insulating element 250 on each side of the housing 120, 122 to further reduce the risk of flashover, discharges or arcing between components or units of a switchgear.

Figure 16:
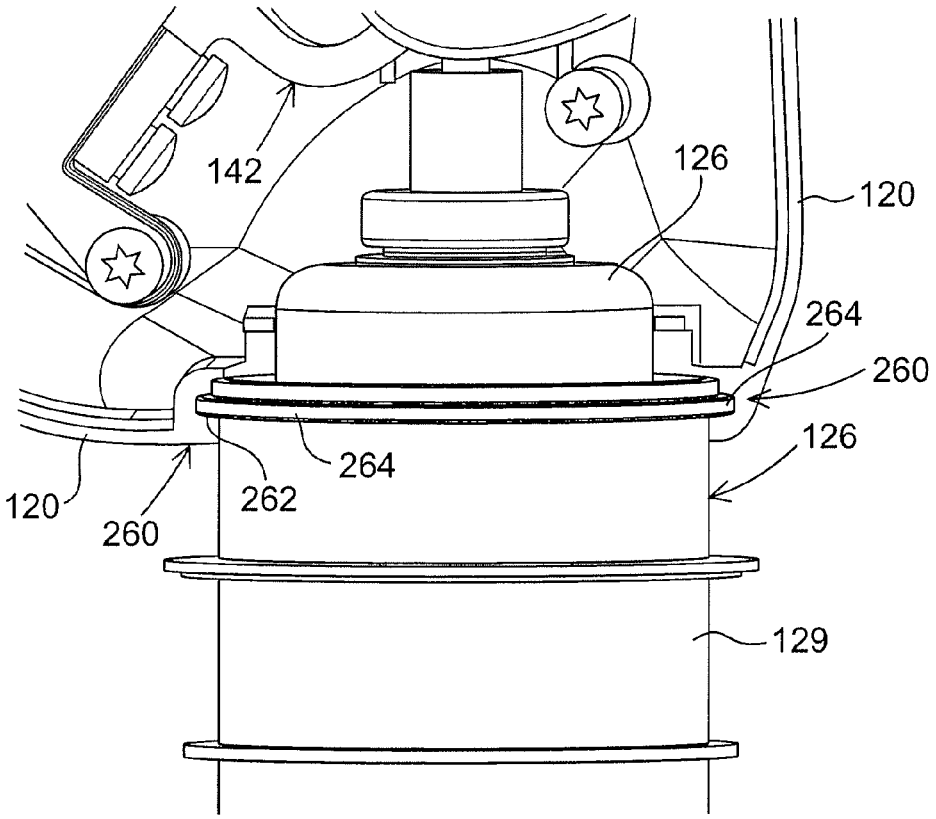
FIG. 16 is a schematic detail view of the connection between the breaker and the housing.

FIG. 16 schematically shows an embodiment of the connection between the breaker 126 and the housing 120. The breaker 126 may be held by a cylindrical container 129 which engages the housing 120. The container 129 may be made of a polymer material. The container 129 may house the breaker 126. The container 129 and the housing 120 may comprise holding means 260 for firmly attaching the container 129 to the housing 120. The holding means 260 may comprise at least one groove 262 and at least one rim 264, the rim 264 being adapted to engage the groove 262. The container 129 may be provided with the rim 264 and the housing may be provided with the groove 262, or vice versa. The rim 264 may be circumferential around the container 129. The groove 262 may be circumferential around the container 129.

Figure 17:
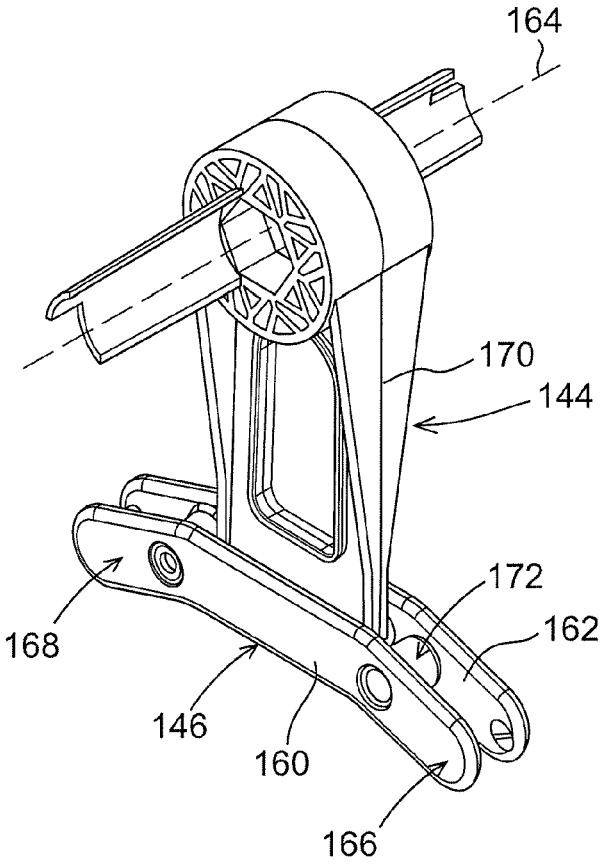
FIGS. 17-19 are schematic views of an embodiment of the switch of the switching device of FIGS. 2-6.
Figure 18:
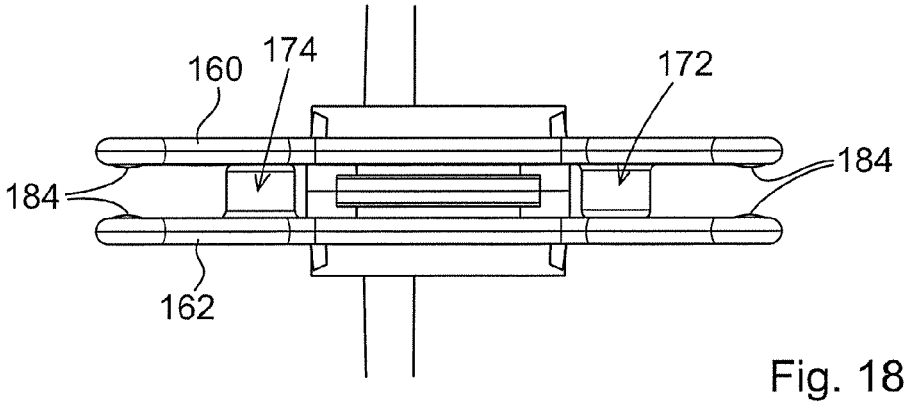
Figure 19:
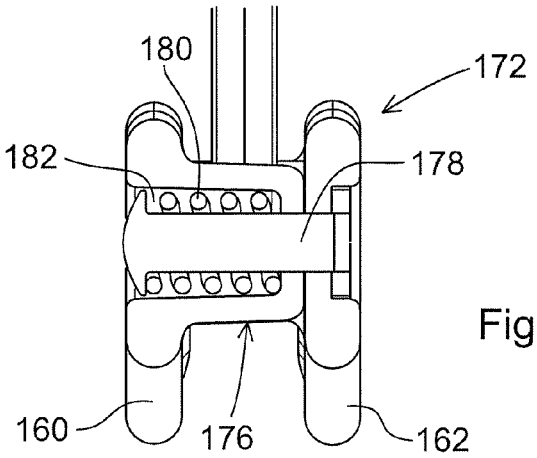

With reference to FIGS. 17-19, the above-mentioned switch 144 is schematically shown in more detail. As mentioned above, the switch 144 comprises a switch element 146. The switch element 146 may comprise two electrically conductive switch knives 160, 162 which may be substantially parallel to one another. When connected to the conductive member 132, the switch element 146 may be arranged to receive the conductive member 132 between the two switch knives 160, 162 to provide an efficient contact. Alternatively, the switch element may comprise a single switch knife. The switch element 146 is pivotable about an axis of rotation 164. The switch element 146 may have first end portions 166 and second end portions 168 between which the switch element 146 extends. The axis of rotation 164 of the switch element 146 is located outside of the switch element 146. The switch element 146 may have an elongated extension, and the switch element 146 may be displaced from the axis of rotation 164 of the switch element 146. Alternatively, the axis of rotation of the switch element may intersect the switch element. The switch element 146 may be pivotally mounted to its axis of rotation 164, located outside the housing 120, via an intermediate element 170 which connects the switch element 146 to the axis of rotation 164. With reference to FIG. 18, which shows the switch element 146 as viewed from below, the two switch knives 160, 162 may be connected to one another by connection means 172, 174. With reference to FIG. 19, a cross-section of a connection means 172 is shown. Each connections means 172 may comprise a hollow protrusion 176 integral with one of the switch knives 160. The protrusion 176 abuts the other switch knife 162. Each connections means 172 may comprise an attachment element 178 and a compression spring 180. The compression spring 180 is housed in an inner space 182 of the hollow protrusion 176 and is held in place by the attachment element 178. The attachment element 178 may extend axially inside the inner space 182 of the hollow protrusion 176 and may be attached to the other switch knife 162. The compression spring 180 may surround the attachment element 178. By means of the connections means 172, 172, the switch knives 160, 162 may be efficiently biased against the conductive member 132 and an efficient contact between the switch element 146 and the conductive member 132 is attained. Further, each switch knife 160, 162 may have projections 184 to further enhance the contact between the switch element 146 and the conductive member 132.

Figure 20:
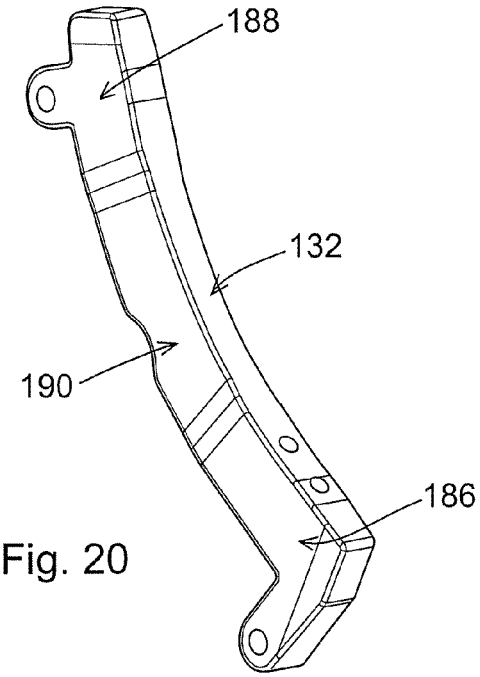
FIGS. 20-21 are schematic views of an embodiment of the conductive member, which forms the first part of the current path between the breaker and the electrical conductor, of the switching device of FIGS. 2-6.
Figure 21:
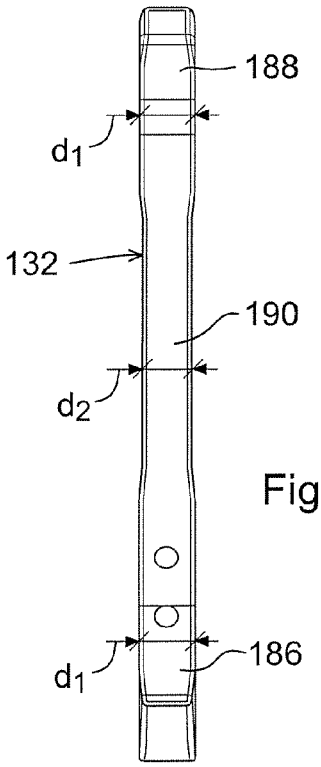

With reference to FIGS. 20-21, the above-mentioned conductive member 132 is schematically shown in more detail. The conductive member 132 may be slightly curved. The conductive member 132 may have a first end portion 186 and a second end portion 188 between which the conductive member 132 extends. The conductive member 132 may have an intermediate portion 190 between the first and second end portions 186, 188, and the thickness $d_1$ of the first and second end portions 186, 188 may be greater than the thickness $d_2$ of the intermediate portion 190. By the difference in thickness between the intermediate portion 190 and the end portions 186, 188, the movement of the switch element 146 is facilitated and improved.

Figure 2:
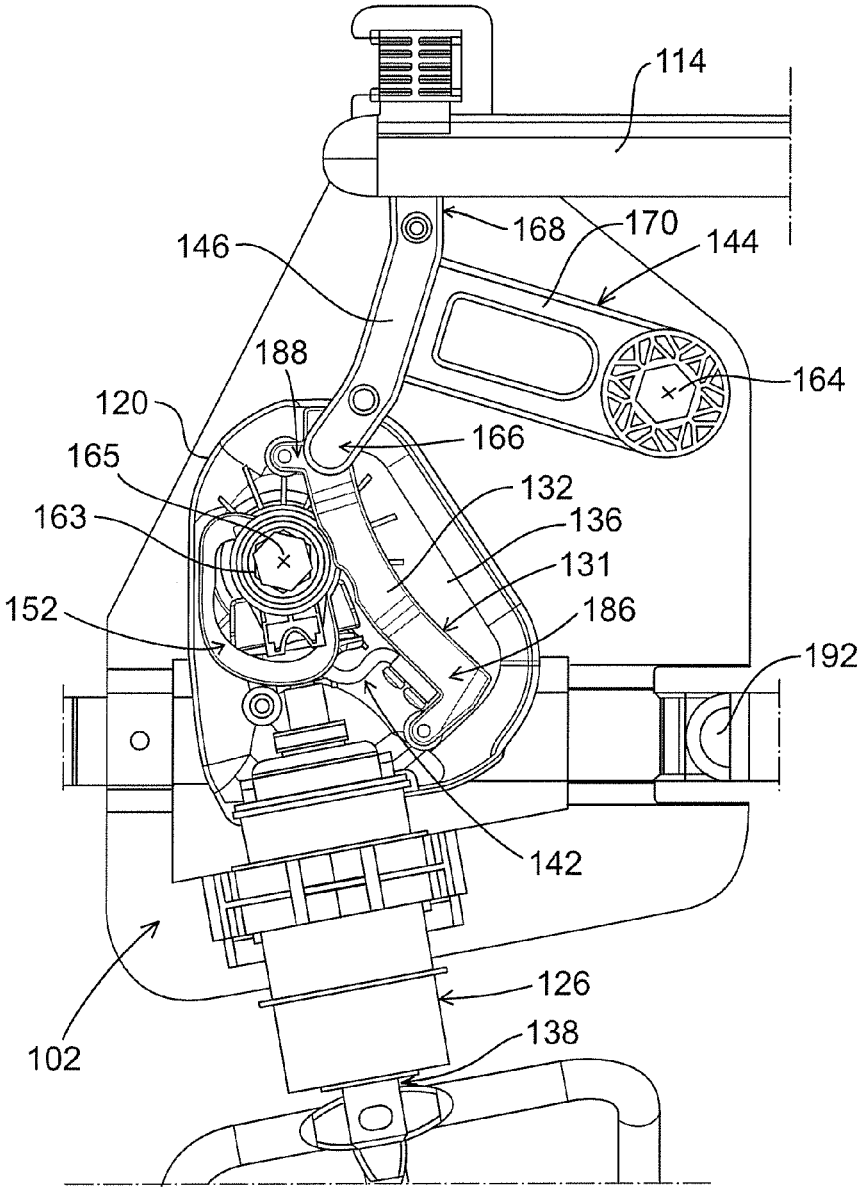
FIGS. 2-4 are schematic cutaway views of the embodiment of the switchgear and of one of the embodiments of the switching device of FIG. 1.

With reference to FIGS. 2-5, the operation of the switch 144 is illustrated in more detail. In FIGS. 2-5, the switching device 102 of only one phase is shown. The switching devices 104, 106 not shown in FIGS. 2-5 are arranged in parallel with the one shown and are thus either hidden behind the one shown or located in planes in front of the latter. The switch element 146 of the switch 144 is movable to a first position in which the switch element 146 is physically connected and electrically connected to the first part 131 of the current path, i.e. to the conductive member 132, and to the electrical conductor 114, and thereby providing a current path between the breaker 126 and the electrical conductor 114. In the first position the switch element 146 may be electrically connectable to an electrical conductor 114 located outside of the housing 120. The first position of the switch element 146 is illustrated in FIG. 2 (and also in FIG. 1). In the first position the first end portion 166 of the switch element 146 may be arranged to be physically connected and electrically connected to the conductive member 132, more precisely to the second end portion 188 of the conductive member 132, and the second end portion 168 of the switch element 146 may be arranged to be physically connected and electrically connected to the electrical conductor 114.

Figure 3:
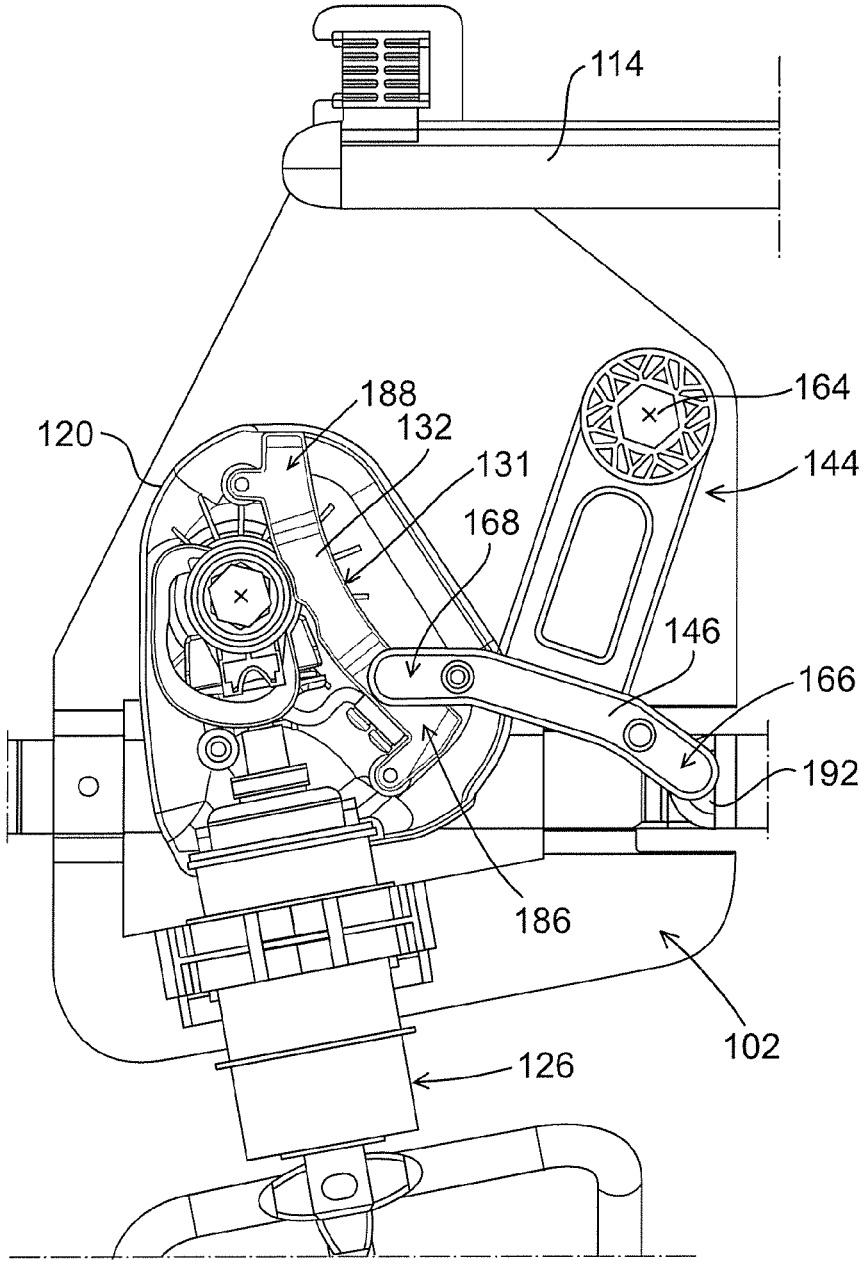

The switch element 146 of the switch 144 is movable to a second position in which the switch element 146 is disconnected from the electrical conductor 114 and physically connected and electrically connected to the conductive member 132 and to a grounded/earthed element 192. The second position of the switch element 146 is illustrated in FIG. 3. In the second position the second end portion 168 of the switch element 146 may be arranged to be physically connected and electrically connected to the conductive member 132, more precisely to the first end portion 186 of the conductive member 132, and the first end portion 166 of the switch element 144 may be arranged to be physically connected and conductively connected to the grounded element 192.

Figure 4:
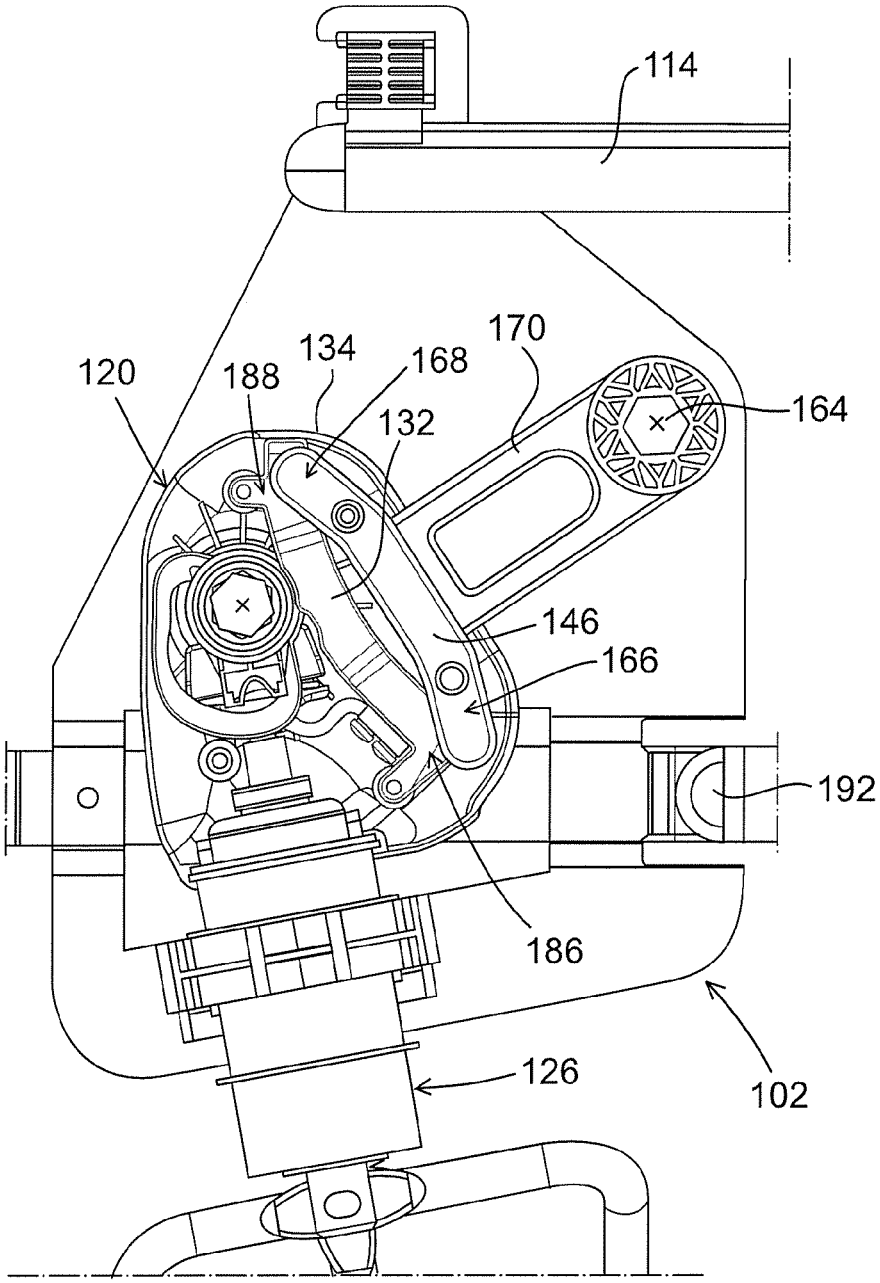

The switch element 146 of the switch 144 is movable to a third position in which the switch element 146 is disconnected from the electrical conductor 114 and disconnected from the grounded element 192. The third position of the switch element 146 is illustrated in FIG. 4. In the third position, the switch element 146 may be arranged to be physically connected and electrically connected to the conductive member 132. In the third position the first and second end portions 166, 168 of the switch element 146 may be physically connected and electrically connected to the conductive member 132, more precisely, to the first and second end portions 186, 188 of the conductive member 132. In the third position, the switch element 146 may be situated within the outer surface 134 of the housing 120.

As previously mentioned, advantageously, the switch element 146 is pivotable about the axis of rotation 164 and pivotable between the first, second and third positions. The axis of rotation 164 of the switch element 146 may be located outside of the outer surface 134 of the housing 120.

The grounded element 192 and the electrical conductor 114 may be arranged to engage the space between to the two switch knives 160, 162 of the switch element 146, to attain an efficient contact.

FIG. 5 shows the exterior of the housing 120 shown in FIGS. 2-4, when the switch element 146 is in the third position, as shown in FIG. 4, and thus is disconnected from the electrical conductor 114 and from the grounded element 192 and situated within the outer surface 134 of the housing 120. As mentioned above, the outer shape of the housing 120 and the outer surface 134 of the housing 120 are smooth to distribute the electric field generated by the voltage of the current through the switching device 102.

The switch 144 acts as a so called safety switch, or selector switch, which is not adapted to break a medium or high voltage circuit itself, but is adapted to disconnect the breaker from a medium or high voltage line after breaking has been performed by means of the breaker 126. The reasons for having a three-position switch element in a switchgear are well known to persons skilled in the art and are not described in more detail herein. The second position of the switch 144 may be regarded as a safety position, enabling safe repair and service on components such as cables connected to the switchgear. The third position may be regarded as a switched-off position.

By the innovative design of the switch 144, the distribution of the electric field and the electric field stress is improved, and enables a switchgear with a compact design.

Each housing of the embodiments described above may be adapted to be at an electric potential which is substantially equal to the electric potential of the second contact of the breaker during the operation of the switching device.

It is to be understood that the switchgear may comprise a plurality of switchgears, or units, such as the one described above. For each electric phase there may be a common bus bar, like the electrical conductor described above, which extends from unit to unit. The encapsulation may or may not be common for the plurality of switchgears/units. The encapsulation may be filled with an electrically insulating gas or gas mixture, which may be pressurised. Air-filled encapsulations are also possible.

Alternative designs of the arrangement of the three position switch and the current path of the switching device is disclosed in the European patent application No. 09179639.1, which is hereby incorporated by reference.

The invention shall not be considered limited to the embodiments illustrated, but can be modified and altered in many ways by one skilled in the art, without departing from the scope of the appended claims.

What is claimed is:

1. A switching device for electric power distribution, electrically connectable to an electrical conductor, the switching device comprising;

a breaker electrically connectable to the electrical conductor, and an at least partially electrically conductive housing to which the breaker is mounted, the housing having an outer surface, the breaker comprising at least one electrically conductive first contact and one electrically conductive second contact, the second contact being movable and in relation to the first contact and in relation to the housing, and when the first and second contacts are in contact the breaker is in a closed position, and when the first and second contacts are separated the breaker is in an open position, the switching device being arranged to provide a current path between the breaker and the electrical conductor, and the housing houses at least one guiding member for operating the second contact, the at least one guiding member being movable in relation to the housing, the at least one guiding member comprising a biasing assembly arranged to bias the second contact against the first contact when the breaker is in the closed position, and the biasing assembly comprising a plurality of biasing members comprising a first biasing member and a second biasing member, characterized in that the housing is provided with a through-hole for suspension of the housing, the switching device comprises a shaft inserted into the through-hole of the housing, the shaft configured to rotate about its longitudinal axis and in relation to the housing, the shaft is connected to the at least one guiding member and in that the shaft and its rotation is adapted to control the movement of the at least one guiding member.

2. The switching device of claim 1, wherein the second contact is axially movable along a first axis, and in that the first biasing member is radially displaced from the second biasing member in relation to the first axis.

3. The switching device of claim 2, wherein the first biasing member is radially separated from the second biasing member in relation to the first axis.

4. The switching device of claim 2, wherein the biasing assembly is movable in the direction of the first axis, and in that the biasing assembly is indirectly or directly connected to the second contact.

5. The switching device of claim 1, characterized wherein the first biasing member comprises a first compression spring and the second biasing member comprises a second compression spring, in that the first compression spring defines a first longitudinal central axis and the second compression spring defines a second longitudinal central axis, and in that the first central axis is displaced from the second central axis.

6. The switching device of claim 5, wherein the first central axis is radially displaced from and substantially parallel to the second central axis.

7. The switching device of claim 1, wherein the biasing assembly comprises a biasing assembly casing which houses the plurality of biasing members.

8. The switching device of claim 7, wherein the biasing assembly casing comprises a first compartment and a second compartment, in that the first compartment houses the first biasing member, and in that the second compartment houses the second biasing member.

9. The switching device of claim 7, wherein the biasing assembly casing is made of at least one cast part.

10. The switching device of claim 1, wherein the housing is adapted to be at an electric potential which is substantially equal to the electric potential of the second contact of the breaker during the operation of the switching device.

11. The switching device of claim 1, wherein the outer surface of the housing is smoothly curved towards and into the through-hole.

12. The switching device of claim 1, wherein the housing houses a first part of the current path between the breaker and the electrical conductor, the first part of the current path being electrically connected to the breaker, wherein the switching device comprises a switch for electrically connecting the breaker to the electrical conductor, and wherein the switch comprises a switch element movable to a first position in which the switch element is electrically connected to the first part of the current path and to the electrical conductor, movable to a second position in which the switch element is disconnected from the electrical conductor and electrically connected to the first part of the current path and to a grounded element, and movable to a third position in which the switch element is disconnected from the electrical conductor and from the grounded element.

13. The switching device of claim 1, wherein the housing is made of at least one cast part.

14. The switching device of claim 1, wherein the housing has a smooth outer shape to distribute the electric field generated by the voltage of the current through the switching device.

15. A switchgear for electric power distribution, wherein the switchgear comprising at least one switching device according to claim 1.

16. The switchgear of claim 15, wherein the switchgear comprises an encapsulation housing the at least one switching device.

17. The switching device of claim 1, wherein the first biasing member and the second biasing member are separate from one another.

18. A switching device for electric power distribution, electrically connectable to an electrical conductor, the switching device comprising:

a breaker electrically connectable to the electrical conductor, and an at least partially electrically conductive housing to which the breaker is mounted, the housing having an outer surface, the breaker comprising at least one electrically conductive first contact and one electrically conductive second contact, the second contact being movable and in relation to the first contact and in relation to the housing, and when the first and second contacts are in contact the breaker is in a closed position, and when the first and second contacts are separated the breaker is in an open position, the switching device being arranged to provide a current path between the breaker and the electrical conductor, and the housing houses at least one guiding member for operating the second contact, the at least one guiding member being movable in relation to the housing, the at least one guiding member comprising a biasing assembly arranged to bias the second contact against the first contact when the breaker is in the closed position, and the biasing assembly comprising a plurality of biasing members comprising a first biasing member and a second biasing member, characterized in that the housing is provided with a through-hole for suspension of the housing, the switching device comprises a shaft inserted into the through-hole of the housing, the shaft is rotatable about its longitudinal axis and in relation to the housing, the shaft is connected to the at least one guiding member and in that the shaft and its rotation is adapted to control the movement of the at least one guiding member, characterized in that the second contact is axially movable along a first axis, and in that the first biasing member is radially displaced from the second biasing member in relation to the first axis, characterized in that the biasing assembly is movable in the direction of the first axis, and in that the biasing assembly is indirectly or directly connected to the second contact, characterized in that the at least one guiding member comprises at least one pivoting arm rotatable about a pivot axis, in that the pivoting arm and the biasing assembly comprise complementary guiding means for transferring rotary movement of the pivoting arm to axial movement of the biasing assembly, and in that the pivoting arm is arranged to control the axial movement of the biasing assembly and of the second contact.

19. The switching device of claim 18, wherein the switching device comprises second complementary guiding means for guiding the biasing assembly in a linear direction.

20. The switching device of claim 18, wherein the pivot axis is substantially perpendicular to the first axis.

* * * * *